US006742864B2

(12) United States Patent
Therien et al.

(10) Patent No.: US 6,742,864 B2
(45) **Date of Patent: *Jun. 1, 2004**

(54) WASTE INK REMOVAL SYSTEM

(75) Inventors: Patrick J. Therien, Battle Ground, WA (US); Christopher B. Miller, Portland, OR (US); Ramon Vega, Barcelona (ES); Xavier Bruch, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 4 days.

This patent is subject to a terminal disclaimer.

(21) Appl. No.: 10/138,591

(22) Filed: Apr. 30, 2002

(65) Prior Publication Data

US 2003/0202037 A1 Oct. 30, 2003

(51) Int. Cl.[7] ..... B41J 2/165

(52) U.S. Cl. ..... 347/36; 347/1; 347/22; 347/33; 347/35

(58) Field of Search ..... 347/1, 22, 29, 347/30, 31, 32, 33, 35, 81

(56) References Cited

U.S. PATENT DOCUMENTS

| | | | | |
|---|---|---|---|---|
| 5,617,124 A | | 4/1997 | Taylor et al. | 347/35 |
| 6,086,190 A | | 7/2000 | Schantz et al. | 347/81 |
| 6,454,373 B1 | | 9/2002 | Therien et al. | 347/1 |
| 6,454,374 B1 | * | 9/2002 | Therien | 347/1 |
| 6,491,366 B1 | | 12/2002 | Therien | 347/22 |
| 6,550,887 B2 | | 4/2003 | Therien et al. | 347/22 |

OTHER PUBLICATIONS

Hewlett–Packard Company patent application; application No. 09/773,881; titled "Uni–Directional Waste Ink Removal System"; filed on Jan. 31, 2001.

Hewlett–Packard Company patent application; application No. 09/773,873; titled "Ink Drop Detector Waste Ink Removal System"; filed on Jan. 31, 2001.

Hewlett–Packard Company patent application; application No. 09/915,461; titled "Ink Drop Detector"; filed on Jul. 25, 2001.

Hewlett–Packard Company patent application; application No. 09/916,008; titled "Ink Drop Detector Configurations"; filed on Jul. 25, 2001, pending.

Hewlett–Packard Company patent application; application No. 09/933,688; titled "Ink Drop Detector Waste Ink Removal System"; filed on Aug. 20, 2001.

* cited by examiner

*Primary Examiner*—Shih-Wen Hsieh

(57) ABSTRACT

A waste ink removal system for cleaning ink residue from an ink drop sensing belt in a printing mechanism is provided. The waste ink removal system has a base, an actuator coupled to the sensing belt, and an ink removal member, supported by the base, which removes ink residue from the sensing belt when the sensing belt is moved by the actuator. A method for drop detection, and a printing mechanism having such a waste ink removal system are also provided.

16 Claims, 3 Drawing Sheets

WASTE INK REMOVAL SYSTEM

INTRODUCTION

Printing mechanisms often include an inkjet printhead which is capable of forming an image on many different types of media. The inkjet printhead ejects droplets of colored ink through a plurality of orifices and onto a given media as the media is advanced through a printzone. The printzone is defined by the plane created by the printhead orifices and any scanning or reciprocating movement the printhead may have back-and-forth and perpendicular to the movement of the media. Conventional methods for expelling ink from the printhead orifices, or nozzles, include piezo-electric and thermal techniques which are well-known to those skilled in the art. For instance, two earlier thermal ink ejection mechanisms are shown in U.S. Pat. Nos. 5,278,584 and 4,683,481, both assigned to the present assignee, the Hewlett-Packard Company.

In a thermal inkjet system, a barrier layer containing ink channels and vaporization chambers is located between a nozzle orifice plate and a substrate layer. This substrate layer typically contains linear arrays of heater elements, such as resistors, which are individually addressable and energized to heat ink within the vaporization chambers. Upon heating, an ink droplet is ejected from a nozzle associated with the energized resistor. The inkjet printhead nozzles are typically aligned in one or more linear arrays substantially parallel to the motion of the print media as the media travels through the printzone. The length of the linear nozzle arrays defines the maximum height, or "swath" height of an imaged bar that would be printed in a single pass of the printhead across the media if all of the nozzles were fired simultaneously and continuously as the printhead was moved through the printzone above the media.

Typically, the print media is advanced under the inkjet printhead and held stationary while the printhead passes along the width of the media, firing its nozzles as determined by a controller to form a desired image on an individual swath, or pass. The print media is usually advanced between passes of the reciprocating inkjet printhead in order to avoid uncertainty in the placement of the fired ink droplets. If the entire printable data for a given swath is printed in one pass of the printhead, and the media is advanced a distance equal to the maximum swath height in-between printhead passes, then the printing mechanism will achieve its maximum throughput.

Often, however, it is desirable to print only a portion of the data for a given swath, utilizing a fraction of the available nozzles and advancing the media a distance smaller than the maximum swath height so that the same or a different fraction of nozzles may fill in the gaps in the desired printed image which were intentionally left on the first pass. This process of separating the printable data into multiple passes utilizing subsets of the available nozzles is referred to by those skilled in the art as "shingling," "masking," or using "print masks." While the use of print masks does lower the throughput of a printing system, it can provide offsetting benefits when image quality needs to be balanced against speed. For example, the use of print masks allows large solid color areas to be filled in gradually, on multiple passes, allowing the ink to dry in parts and avoiding the large-area soaking and resulting ripples, or "cockle," in the print media that a single pass swath would cause.

A printing mechanism may have one or more inkjet printheads, corresponding to one or more colors, or "process colors" as they are referred to in the art. For example, a typical inkjet printing system may have a single printhead with only black ink; or the system may have four printheads, one each with black, cyan, magenta, and yellow inks; or the system may have three printheads, one each with cyan, magenta, and yellow inks. Of course, there are many more combinations and quantities of possible printheads in inkjet printing systems, including seven and eight ink/printhead systems.

Each process color ink is ejected onto the print media in such a way that the drop size, relative position of the ink drops, and color of a small, discreet number of process inks are integrated by the naturally occurring visual response of the human eye to produce the effect of a large colorspace with millions of discernable colors and the effect of a nearly continuous tone. In fact, when these imaging techniques are performed properly by those skilled in the art, near-photographic quality images can be obtained on a variety of print media using only three to eight colors of ink.

This high level of image quality depends on many factors, several of which include: consistent and small ink drop size, consistent ink drop trajectory from the printhead nozzle to the print media, and extremely reliable inkjet printhead nozzles which do not clog.

To this end, many inkjet printing mechanisms contain a service station for the maintenance of the inkjet printheads. These service stations may include scrapers, ink-solvent applicators, primers, and caps to help keep the nozzles from drying out during periods of inactivity. Additionally, inkjet printing mechanisms often contain service routines which are designed to fire ink out of each of the nozzles and into a waste spittoon in order to prevent nozzle clogging.

Despite these preventative measures, however, there are many factors at work within the typical inkjet printing mechanism which may clog the inkjet nozzles, and inkjet nozzle failures may occur. For example, paper dust may collect on the nozzles and eventually clog them. Ink residue from ink aerosol or partially clogged nozzles may be spread by service station printhead scrapers into open nozzles, causing them to be clogged. Accumulated precipitates from the ink inside of the printhead may also occlude the ink channels and the nozzles. Additionally, the heater elements in a thermal inkjet printhead may fail to energize, despite the lack of an associated clogged nozzle, thereby causing the nozzle to fail.

Clogged or failed printhead nozzles result in objectionable and easily noticeable print quality defects such as banding (visible bands of different hues or colors in what would otherwise be a uniformly colored area) or voids in the image. In fact, inkjet printing systems are so sensitive to clogged nozzles, that a single clogged nozzle out of hundreds of nozzles is often noticeable and objectionable in the printed output.

It is possible, however, for an inkjet printing system to compensate for a missing nozzle by removing it from the printing mask and replacing it with an unused nozzle or a used nozzle on a later, overlapping pass, provided the inkjet system has a way to tell when a particular nozzle is not functioning. In order to detect whether an inkjet printhead nozzle is firing, a printing mechanism may be equipped with a number of different ink drop detector systems.

One type of ink drop detector system utilizes a piezoelectric target surface that produces a measurable signal when ink droplets contact the target surface. Unfortunately, however, this type of technology is expensive and often is unable to detect the extremely small drops of ink used in inkjet printing systems with photographic image quality.

Another type of ink drop detector utilizes an optical sensor which forms a measurable signal when an ink droplet passes through a light beam from a sensory circuit. Unfortunately, this method is subject to extremely tight alignment tolerances which are difficult and expensive to setup and maintain. Additionally, an optical ink drop detection system is susceptible to the ink aerosol which results from the firing of the inkjet printhead inside of the printing mechanism. The aerosol coats the optical sensor over time, degrading the optical sensor signal and eventually preventing the optical sensor from functioning.

A more effective solution for ink drop detection is to use a low cost ink drop detection system, such as the one described in U.S. Pat. No. 6,086,190 assigned to the present assignee, Hewlett-Packard Company. This drop detection system utilizes an electrostatic sensing element which is imparted with an electrical stimulus when struck by a series of ink drop bursts ejected from an inkjet printhead. The electrostatic sensing element may be made sufficiently large so that printhead alignment is not critical, and the sensing element may function with amounts of ink or aerosol on the sensing element surface which would incapacitate other types of drop detection sensors.

In practical implementation, however, this electrostatic sensing element has some limitations. First, successive drops of ink, drying on top of one another quickly form stalagmites of dried ink which may grow toward the printhead. Since it is preferable to have the electrostatic sensing element very close to the printhead for more accurate readings, these stalagmites may eventually interfere with or permanently damage the printhead, adversely affecting print quality. Second, as the ink residue dries, it remains conductive and may short out the drop detector electronics as the ink residue grows and spreads. Thus, this dried residue impairs the ability of the sensor to measure the presence of drops properly.

Therefore, it is desirable to have a method and mechanism for effectively removing the waste ink residue from an electrostatic ink drop detector in an inkjet printing mechanism.

DETAILED DESCRIPTION OF THE PREFERRED EMBODIMENTS

Figure 1:
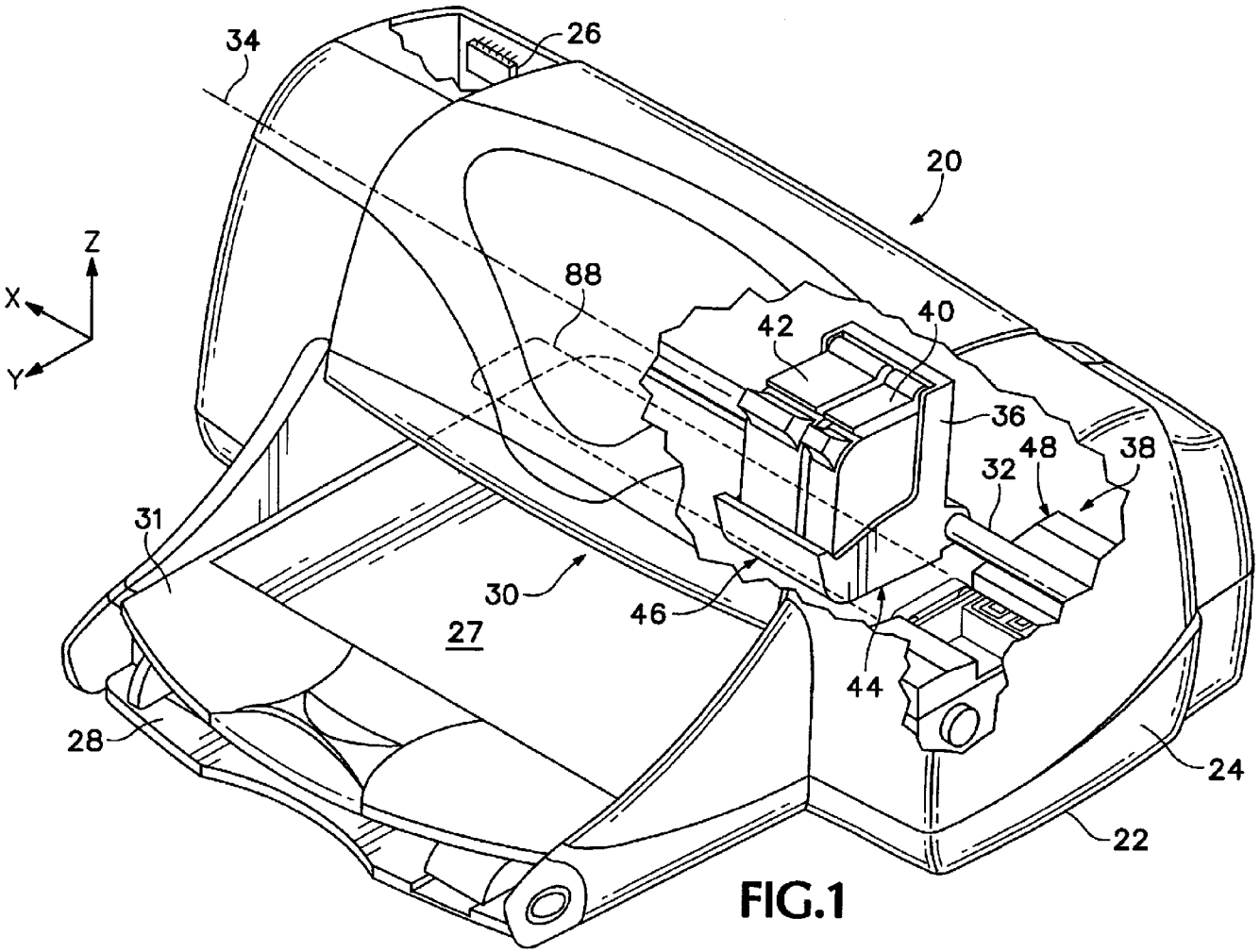
FIG. 1 is a fragmented perspective view of one form of an inkjet printing mechanism, here including a service station having one embodiment of an electrostatic ink drop detector.

FIG. 1 illustrates an embodiment of a printing mechanism, here shown as an inkjet printer 20, constructed in accordance with the present invention, which may be used for printing on a variety of media, such as paper, transparencies, coated media, cardstock, photo quality papers, and envelopes in an industrial, office, home or other environment. A variety of inkjet printing mechanisms are commercially available. For instance, some of the printing mechanisms that may embody the concepts described herein include desk top printers, portable printing units, wide-format printers, hybrid electrophotographic-inkjet printers, copiers, cameras, video printers, and facsimile machines, to name a few. For convenience the concepts introduced herein are described in the environment of an inkjet printer 20.

While it is apparent that the printer components may vary from model to model, the typical inkjet printer 20 includes a chassis 22 surrounded by a frame or casing enclosure 24, typically of a plastic material. The printer 20 also has a printer controller, illustrated schematically as a microprocessor 26, that receives instructions from a host device, such as a computer or personal data assistant (PDA) (not shown). A screen coupled to the host device may also be used to display visual information to an operator, such as the printer status or a particular program being run on the host device. Printer host devices, such as computers and PDA's, their input devices, such as a keyboards, mouse devices, stylus devices, and output devices such as liquid crystal display screens and monitors are all well known to those skilled in the art.

A conventional print media handling system (not shown) may be used to advance a sheet of print media 27 from the media input tray 28 through a printzone 30 and to an output tray 31. A carriage guide rod 32 is coupled to the chassis 22 to define a scanning axis 34, with the guide rod 32 slidably supporting an inkjet carriage 36 for travel back and forth, reciprocally, across the printzone 30. A conventional carriage drive motor (not shown) may be used to propel the carriage 36 in response to a control signal received from the controller 26. To provide carriage positional feedback information to controller 26, a conventional encoder strip (not shown) may be extended along the length of the printzone 30 and over a servicing region 38. A conventional optical encoder reader may be mounted on the back surface of printhead carriage 36 to read positional information provided by the encoder strip, for example, as described in U.S. Pat. No. 5,276,970, also assigned to the Hewlett-Packard Company, the present assignee. The manner of providing positional feedback information via the encoder strip reader, may also be accomplished in a variety of ways known to those skilled in the art.

In the printzone 30, the media sheet receives ink from an inkjet cartridge, such as a black ink cartridge 40 and a color inkjet cartridge 42. The black ink cartridge 40 is illustrated herein as containing a pigment-based ink. For the purposes of illustration, color cartridge 42 is described as containing three separate dye-based inks which are colored cyan, magenta, and yellow, although it is apparent that the color cartridge 42 may also contain pigment-based inks in some implementations. It is apparent that other types of inks may also be used in the cartridges 40 and 42, such as paraffin-based inks, as well as hybrid or composite inks having both dye and pigment characteristics. The illustrated printer 20 uses replaceable printhead cartridges where each cartridge has a reservoir that carries the entire ink supply as the printhead reciprocates over the printzone 30. As used herein, the term "cartridge" may also refer to an "off-axis" ink delivery system, having main stationary reservoirs (not shown) for each ink (black, cyan, magenta, yellow, or other colors depending on the number of inks in the system) located in an ink supply region. In an off-axis system, the cartridges may be replenished by ink conveyed through a conventional flexible tubing system from the stationary main reservoirs which are located "off-axis" from the path of printhead travel, so only a small ink supply is propelled by carriage 36 across the printzone 30. Other ink delivery or fluid delivery systems may also employ the systems described herein, such as cartridges which have ink reservoirs that snap onto permanent or semi-permanent print heads.

The illustrated black cartridge 40 has a printhead 44, and color cartridge 42 has a tri-color printhead 46 which ejects cyan, magenta, and yellow inks. The printheads 44, 46 selectively eject ink to form an image on a sheet of media 27 when in the printzone 30. The printheads 44, 46 each have an orifice plate with a plurality of nozzles formed therethrough in a manner well known to those skilled in the art. The nozzles of each printhead 44, 46 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 34, with the length of each array determining the maximum image swath for a single pass of the printhead. The printheads 44, 46 are thermal inkjet printheads, although other types of printheads may be used, such as piezoelectric printheads. The thermal printheads 44, 46 typically include a plurality of resistors which are associated with the nozzles. Upon energizing a selected resistor, a bubble of gas is formed which ejects a droplet of ink from the nozzle and onto the print media 27 when in the printzone 30 under the nozzle. The printhead resistors are selectively energized in response to firing command control signals delivered from the controller 26 to the printhead carriage 36.

Between print jobs, the inkjet carriage 36 moves along the carriage guide rod 32 to the servicing region 38 where a service station 48 may perform various servicing functions known to those in the art, such as, priming, scraping, and capping for storage during periods of non-use to prevent ink from drying and clogging the inkjet printhead nozzles.

Figure 2:
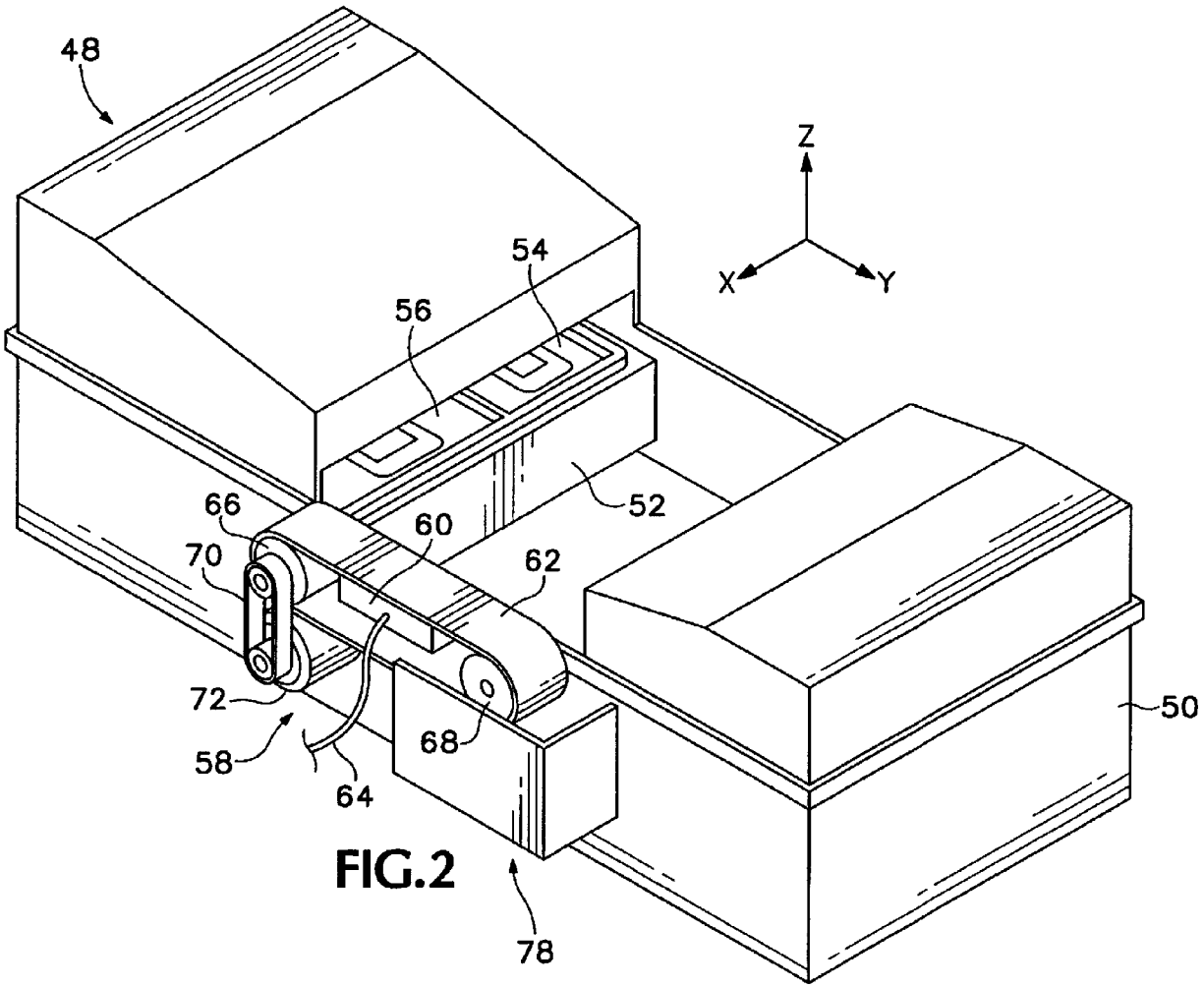
FIG. 2 is an enlarged perspective view of the embodied service station of FIG. 1

FIG. 2 shows the service station 48 in detail. A service station frame 50 is mounted to the chassis 22, and houses a moveable pallet 52. The moveable pallet 52 may be driven by a motor (not shown) to move in the frame 50 in the positive and negative Y-axis directions. The moveable pallet 52 may be driven by a rack and pinion gear powered by the service station motor in response to the microprocessor 26 according to methods known by those skilled in the art. An example of such a rack and pinion system in an inkjet cleaning service station can be found in U.S. Pat. No. 5,980,018, assigned to the Hewlett-Packard Company, also the current assignee. The end result is that pallet 52 may be moved in the positive Y-axis direction to a servicing position and in the negative Y-axis direction to an uncapped position. The pallet 52 supports a black printhead cap 54 and a tri-color printhead cap 56 to seal the printheads 44 and 46, respectively, when the moveable pallet 52 is in the servicing position, here a capping position.

FIG. 2 also shows an ink drop detector 58 supported by the service station frame 50. Clearly, the ink drop detector 58 could be mounted in other locations along the printhead scanning axis 34, including the opposite side of the service station frame 50, inside the service station 48, or on the opposite end of the printer 20 from the service station 48, for example. However, the illustrated location of the ink drop detector 58 will be used as one example of principles of manufacture and operation, although other locations may be more suitable in other implementations.

The ink drop detector 58 has a printed circuitboard assembly (PCA) 60 which is supported by the service station frame 50. The PCA 60 is electrically coupled to a conductive electrostatic sensing belt 62, or "target" onto which ink droplets may be fired and detected according to the apparatus and method described in U.S. Pat. No. 6,086,190, assigned to the Hewlett-Packard Company, the present assignee. The PCA 60 may be electrically coupled to the sensing belt 62 through a stationary conductor or a moveable conductor, such as conductive rollers (not shown). The sensing belt 62 is preferably constructed of an elastomer impregnated with metal fibers. Alternatively, the sensing belt 62 could also be made of high strength fabric that is treated with an ink vehicle, such as ethylene glycol, thereby rendering the sensing belt 62 conductive. The PCA 60 contains various electronics (not shown) for filtering and amplification of drop detection signals received from the sensing belt 62. An electrical conductor 64 links the PCA 60 to microprocessor 26 for drop detection signal processing. Alternatively, the PCA 60 could be located away from the sensing belt 62, provided an electrical contact is maintained between the PCA 60 and the sensing belt 62. It is preferable, however, to have the amplification and filtering electronics of PCA 60 as close to the sensing belt 62 as possible in order to increase the signal to noise ratio of electrical currents induced on the sensing belt by electrically charged ink droplets. The induced electrical currents make a current signature which is a main input to be interpreted by the ink drop detector 58 and microprocessor 26.

The sensing belt 62 may be supported on rollers 66, 68 as shown in FIG. 2. As illustrated, a drive belt 70 may couple roller 66 to a motor 72. Motor 72 may be activated by microprocessor 26 to turn the drive belt 70 and therefore rotate the conductive sensing belt 62. Other actuators, or means of advancing or rotating the sensing belt 62 will be apparent to those skilled in the art, including, but not limited to a direct drive motor, a clutch-based system, a gear-based system, or a cam based system. This specification is intended to cover all such drive systems, and functional equivalents and substitutions for those drive systems.

Figure 3:
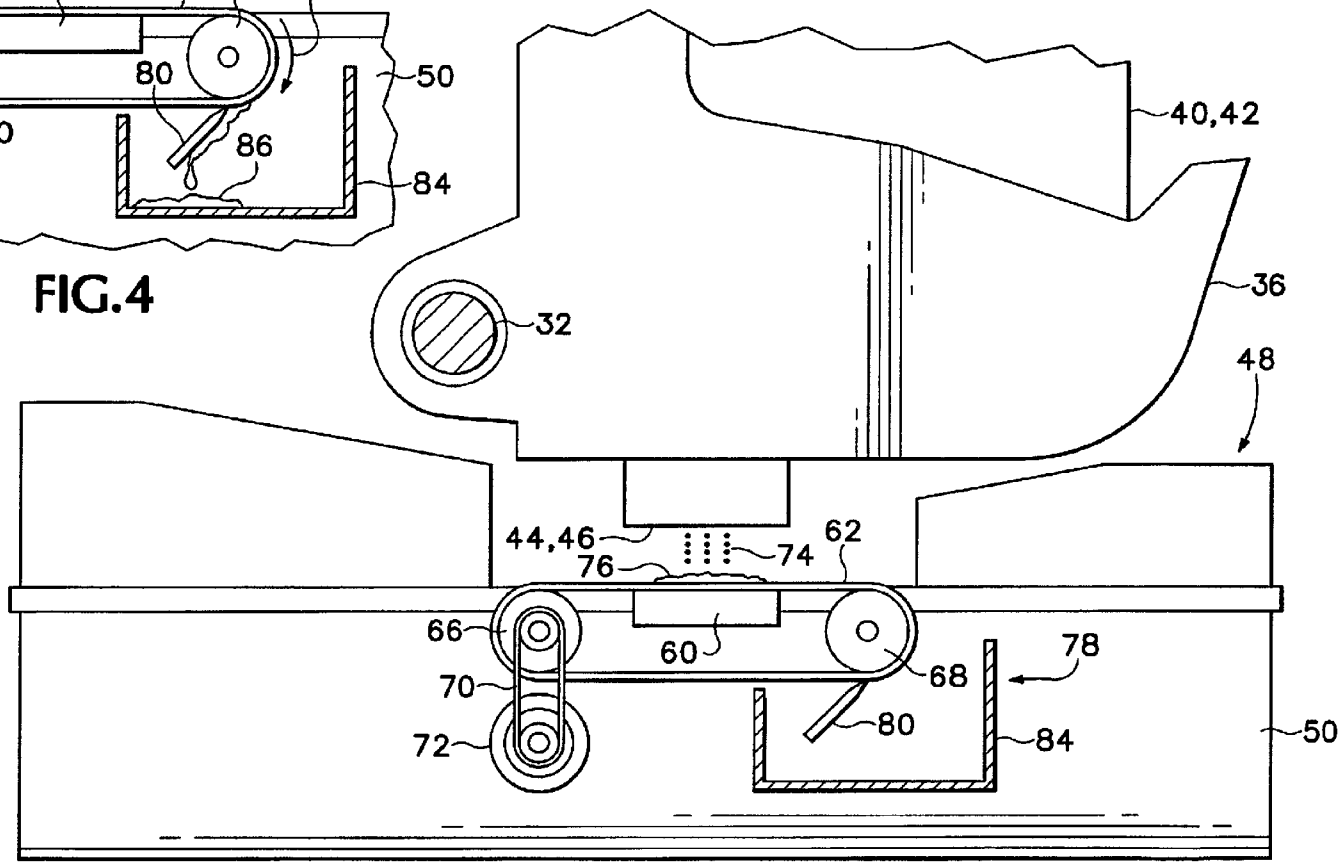
FIG. 3 is an enlarged side elevational view of the embodied service station of FIG. 1 shown with an inkjet printhead firing ink onto one embodiment of an electrostatic ink drop detector.

FIG. 3 illustrates a left-side elevational view of the service station 48, the carriage guide rod 32, and the inkjet carriage 36. The inkjet carriage 36 may be moved along the carriage guide rod 32 until one or more of the printheads 44, 46 are positioned directly over the electrostatic sensing belt 62. It is apparent that the printheads 44, 46 may be positioned over the sensing belt 62 either one at a time or in various simultaneous combinations if allowed by the size of the sensing belt 62, the size of each printhead, and the spacing between the printheads.

The preferred spacing between the printheads 44, 46 and the sensing belt 62 is on the order of two millimeters. Once a printhead 44, 46 is properly aligned with the sensing belt 62, the controller 26 causes ink droplets 74 to be fired from a printhead 44, 46 onto the sensing belt 62. An electrical drop detect signal is generated by the ink droplets 74 as they contact the sensing belt 62, and this signal is captured by the filtering and amplification electronics of PCA 60. The drop detect signal is then analyzed by microprocessor 26 to determine whether or not various nozzles of printhead 44, 46 are spitting ink properly or whether they are clogged. A preferred method of analyzing signals from an electrostatic target ink drop detector is shown in U.S. Pat. No. 6,086,190, also assigned to the present assignee, the Hewlett-Packard Company. Based on the determination made by the microprocessor 26 as to whether each nozzle is functioning properly, the microprocessor 26 may adjust the print masks to substitute functioning nozzles for any malfunctioning nozzles to provide consistent high-quality printed output while still using a printhead with permanently clogged nozzles.

In order to ensure that a reliable measurement may be made by the ink drop detector 58, it is desirable to remove ink residue 76 from the sensing belt 62 after a measurement or series of measurements have been made to prevent excessive deposits of dried ink from accumulating on the surface of the sensing belt 62. Dried ink deposits may short out the electrostatic sensing belt 62, degrading the ability of the ink drop detector 58 to make measurements. Additionally, dried ink deposits may accumulate over time to form stalagmites which eventually grow to interfere with the printheads 44, 46, possibly damaging nozzles which hit the stalagmites, a process known as "stalagmite crashes."

Accordingly, a waste ink removal system 78 may be provided to assist in the removal of ink residue 76. An ink removal member 80, illustrated in FIG. 3 as a scrapper, is positioned in contact with the sensing belt 62. In the embodiment illustrated in FIG. 3, the ink removal member 80 is positioned against the sensing belt 62 opposite roller 68. Roller 68 provides a counterforce to the force supplied by the ink removal member 80. Other embodiments may position the ink removal member 80 over an unsupported portion of the sensing belt 62. Alternatively, other embodiments may position the ink removal member 80 over a portion of the sensing belt 62 which is supported by a different roller or by a backing member (not shown) other than the belt rollers 66, 68.

Figure 4:
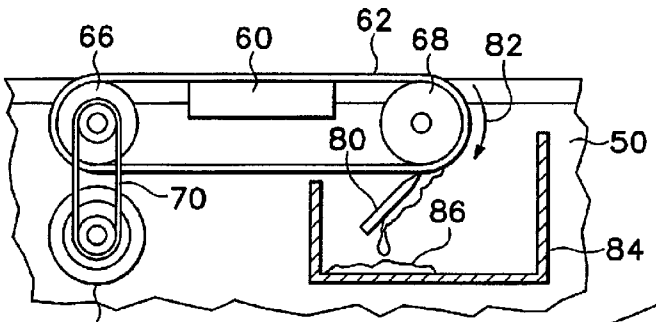
FIG. 4 is an enlarged fragmented side elevational view of the embodied service station of FIG. 1, showing the embodied electrostatic ink drop detector being cleaned by one embodiment of a waste ink removal system.

FIG. 4 illustrates the sensing belt 62 being driven in a clockwise direction 82. This moves the ink residue 76 into interference with the ink removal member 80. The relative motion between the ink removal member 80 and the sensing belt 62 causes the ink residue 76 to be removed from the sensing belt 62. A debris collection bin 84 is attached to the service station frame 50, and positioned to collect ink residue which has been removed 86 from the sensing belt 62. Although the embodiment of FIG. 4 illustrates movement of the sensing belt 62 in a clockwise direction, movement in a counter-clockwise direction or a combination of clockwise and counterclockwise directions is also possible.

The ink removal member 80 is not limited to a scraper in the orientation illustrated for the embodiment of FIG. 4. The scraper angles can be varied, even to the point where the scraper is acting as a wiper. Additionally, pads may also be used to implement an ink removal member 80. Ink removal pads may be constructed of bonded polyester fiber, scintered plastic, or other ink absorbers known to those skilled in the art. Depending on the placement of the ink drop detector 58 in the printer 20, some embodiments may not require a debris collection bin 84. For example, if the ink drop detection system 58 is located inside of the service station frame 50, the ink residue 76 could be scraped directly into the service station frame.

The dimensions of sensing belt 62 may be varied as desired by those skilled in the art. Additionally, the sensing belt 62 may be wound around more than two rollers or belt guides. Also, the sensing belt 62 could be replaced by a conductive sensing wheel or roller, instead of a belt. Some embodiments may use a wide sensing belt 88 (Shown in FIG. 1) for ink drop detection. As shown in the embodiment of FIG. 1, wide sensing belt 88 spans the printzone 30. The printheads 44, 46 will be positioned over the wide sensing belt 88 whenever they are in the printzone 30. Wide sensing belt 88 would also work with a non-reciprocating, full-width printhead. This allows for more opportunities to eject ink onto the wide sensing belt 88. For example, although the print media 27 passes over the wide sensing belt 88, the printheads 44, 46 can eject ink for ink drop detection onto the wide sensing belt 88 during gaps which arise between the different sheets of media 27 which may be fed through the printzone 27. If the print media 27 is supported by the wide sensing belt 88, then the controller 26 rotates the wide sensing belt 88 in a manner which ensures any ink residue on the wide sensing belt 88 is out of the way of any incoming print media 27, before the print media 27 reaches the printzone 30.

A waste ink removal system 78, used in conjunction with an electrostatic ink drop detector system 58, provides the ability to remove ink residue 76 from a sensing belt 62, 88, preventing the formation of stalagmites and ink shorts, thereby preventing damage to the printheads 44, 46 and the ink drop detector 58. Therefore, a waste ink removal system enables a printing mechanism to reliably use ink drop detection readings to provide users with consistent, high-quality, and economical inkjet output despite printheads 44, 46 which may clog over time. In discussing various components of the ink drop detector 58 and the service station 48, various benefits have been noted above.

It is apparent that a variety of other structurally equivalent modifications and substitutions may be made to construct an ink drop detector waste ink removal system according to the concepts covered herein depending upon the particular implementation, while still falling within the scope of the claims below.

We claim:

1. A waste ink removal system for cleaning ink residue from an ink drop sensing belt in a printing mechanism, comprising:

a base;

an actuator coupled to the sensing belt;

an ink removal member, supported by the base, which removes ink residue from the sensing belt when the sensing belt is moved by the actuator.

2. The waste ink removal system of claim 1, wherein the ink removal member is a scraper.

3. The waste ink removal system of claim 1, wherein the ink removal member is a wiper.

4. The waste ink removal system of claim 1, wherein the ink removal member is a pad.

5. The waste ink removal system of claim 1, further comprising a debris collection bin, supported by the base, for collecting the removed ink residue.

6. A printing mechanism, comprising:

a printhead which selectively ejects ink;

an ink drop sensing belt which receives ink from the printhead and accumulates an ink residue thereon; and a waste ink removal system for cleaning ink residue from the ink drop sensing belt, comprising:

a base;

an actuator coupled to the sensing belt;

an ink removal member, supported by the base, which removes ink residue from the sensing belt when the sensing belt is moved by the actuator.

7. The printing mechanism of claim 6, wherein the ink removal member is a scraper.

8. The printing mechanism of claim 6, wherein the ink removal member is a wiper.

9. The printing mechanism of claim 6, wherein the ink removal member is a pad.

10. The printing mechanism of claim 6, further comprising a debris collection bin, supported by the base, for collecting the removed ink residue.

11. The printing mechanism of claim 6, wherein:

the printhead is a stationary printhead and has a width; and the sensing belt extends for at least the width of the printhead.

12. The printing mechanism of claim 6, further comprising a printzone, wherein the sensing belt extends for at least the width of the printzone.

13. A method for ink drop detection in a printing mechanism, comprising:

ejecting ink from a printhead onto a sensing belt;

interpreting a current signature generated by the ink contacting the sensing belt;

rotating the sensing belt; and while rotating the sensing belt, removing the ink from the sensing belt.

14. The method for ink drop detection of claim 13, wherein rotating the sensing belt further comprises supporting a print media on the rotating sensing belt such that the print media does not come into contact with the ink on the sensing belt.

15. A waste ink removal system, comprising:

means for sensing ink drops;

means for rotating the sensing means;

means for ink removal which removes ink residue from the sensing means when the sensing means is rotated by the rotating means.

16. The waste ink removal system of claim 15, further comprising means for collecting ink residue removed from the sensing means.

* * * * *

UNITED STATES PATENT AND TRADEMARK OFFICE

CERTIFICATE OF CORRECTION

PATENT NO. : 6,742,864 B2
DATED : June 1, 2004
INVENTOR(S) : Therien et al.

It is certified that error appears in the above-identified patent and that said Letters Patent is hereby corrected as shown below:

Column 7,
Line 15, delete “scrapper”and insert in lieu thereof -- scraper --.

Signed and Sealed this

Nineteenth Day of April, 2005

JON W. DUDAS
*Director of the United States Patent and Trademark Office*